US011420213B2

(12) United States Patent
McNally

(10) Patent No.: US 11,420,213 B2
(45) Date of Patent: Aug. 23, 2022

(54) MACHINE FOR MAGNETIC SEPARATION

(71) Applicant: ECOHOG LIMITED, Omagh (GB)

(72) Inventor: Declan McNally, Omagh (GB)

(73) Assignee: Ecohog Limited, Carrickmore (GB)

( * ) Notice: Subject to any disclaimer, the term of this patent is extended or adjusted under 35 U.S.C. 154(b) by 159 days.

(21) Appl. No.: 16/596,511

(22) Filed: Oct. 8, 2019

(65) Prior Publication Data

US 2020/0108400 A1 Apr. 9, 2020

(30) Foreign Application Priority Data

Oct. 8, 2018 (GB) ..... 1816400

(51) Int. Cl.
*B03C 1/247* (2006.01)
*B03C 1/14* (2006.01)

(52) U.S. Cl.
CPC ..... *B03C 1/247* (2013.01); *B03C 1/14* (2013.01); *B03C 2201/20* (2013.01)

(58) Field of Classification Search
CPC .... B03C 1/00; B03C 1/32; B03C 1/10; B03C 1/14; B03C 1/145; B03C 1/30; B03C 1/247; B03C 2201/20
USPC ..... 209/223, 226, 230, 420, 421, 287, 288
See application file for complete search history.

(56) References Cited

U.S. PATENT DOCUMENTS 2,728,454 A * 12/1955 Heckett ..... B03B 9/061 241/14
4,051,023 A * 9/1977 Fogle ..... B03C 1/14 210/222
2007/0040057 A1 2/2007 Sato
2009/0065617 A1 3/2009 Yamada
2011/0163015 A1* 7/2011 Shuttleworth ..... B03C 1/14 209/223.2
2016/0332168 A1* 11/2016 Peterson ..... B03C 1/14

FOREIGN PATENT DOCUMENTS

CN 201067704 6/2008
CN 203886928 10/2014
DE 19711544 9/1998
JP H07299381 11/1995
JP H07299381 A * 11/1995
NL 1023923 C2 * 1/2005 ..... B03C 1/16

(Continued)

OTHER PUBLICATIONS

European Search Report dated Feb. 27, 2020.

(Continued)

*Primary Examiner* — Gene O Crawford
*Assistant Examiner* — Muhammad Awais
(74) *Attorney, Agent, or Firm* — Preston Smirman; Smirman IP Law, PLLC

(57) ABSTRACT

A machine is described for magnetic separation of material, wherein the machine includes a supporting structure and at least one magnetic rotating drum supported by the supporting structure, wherein the machine further includes a vehicle for moving and transporting the supporting structure. The magnetic drum includes an outer rotating shell and a magnetic portion including at least one magnet positioned and housed within the outer shell, wherein the outer shell is rotatable around a central axis by a drive mechanism and the at least one magnet is positioned in a fixed location within the outer shell.

20 Claims, 6 Drawing Sheets

(56) References Cited

FOREIGN PATENT DOCUMENTS

| | | | | |
|---|---|---|---|---|
| WO | WO-2008123770 A1 * | 10/2008 | ..... | B03C 1/002 |
| WO | WO-2013142407 A1 * | 9/2013 | ..... | B03C 1/0332 |
| WO | WO-2016038136 A1 * | 3/2016 | ..... | B03C 1/247 |

OTHER PUBLICATIONS

English Abstract of JPH07299381.
English Abstract of CN201067704.
English Abstract of DE19711544.
English Abstract of CN203886928.

* cited by examiner

MACHINE FOR MAGNETIC SEPARATION

CROSS-REFERENCE TO RELATED APPLICATION

The instant application claims priority to United Kingdom Patent Application Serial No. GB1816400.4 filed Oct. 8, 2018, the entire specification of which is expressly incorporated herein by reference.

FIELD OF THE INVENTION

The present invention relates to an improved machine for magnetic separation and in particular for the separation of ferrous from non-ferrous materials in a material stream.

BACKGROUND OF THE INVENTION

For magnetic separation of ferrous and non-ferrous materials is typically used magnetic drum separators. In particular, this kind of separation is usually required in recycling, municipal solid waste, wood waste, slag, incinerator bottom ash, foundry sand, and in mineral processing applications.

More in detail, the magnetic drum separators are used to sort shredded scrap material streams that comprise various combinations of ferrous material and non-ferrous materials (including non-metals, sometimes known as organic material or fluff, and non-magnetic metals) by extracting the ferrous material from the material stream.

Typically, these magnetic drum separators are used within a complex plant/installation wherein they permanently located immediately downstream of shredders and/or grinders that break up non-ferrous scrap that is not extracted into more manageable pieces for sorting and separating.

The known magnetic drum separators usually comprise the following components:

a drum comprising an outer rotating shell and a pickup magnet that is positioned at a fixed location within said outer shell, a first discharge port for the separated magnetic material, and a second discharge port for the separated non-magnetic material.

Conveniently, the magnetic drum separator is associated at the entry with a feeder for transferring the material stream to be separated in correspondence of said drum, while at the output the first discharge port and/or the second discharge port are associated with corresponding conveyor belts.

In particular, the operation of this known magnetic drum separator is as follow: the material stream to be separated coming from the feeder arrives in correspondence of the drum so that the magnet of the latter picks up and holds ferrous (magnetic) materials until they reach the first discharge port, while the non-magnetic materials are not affected by the action of the magnet, thus reaching the second discharge port.

In the known magnetic drum separators all the above-mentioned components, even comprising the feeder and the discharge conveyor belts, are mounted on one or more supporting structures that are permanently fixed on the ground of the installation location.

In other words, the known magnetic drum separators are permanently installed and positioned within a complex and fixed installation or plant, which—in order to be realized—requires important structural works (for example suitable foundations), planning permissions and, of course, building regulations must be respected.

Moreover, in such context, it should be considered that the known magnetic drum separators are typically custom-built and usually are specifically designed according to the needs of the single application, thus being quite complicated to move or adapt a magnetic drum separator from one installation/plant to another one.

It is understood that there could be a need to move a magnetic drum separator in different positions within the same installation/plant or also to move from one installation/plant to another one.

OBJECTS OF THE INVENTION

It is an object of the present invention to prevent or mitigate the problems of having a magnetic drum separator that is fixed, thus providing a machine for magnetic separation that can be easily moved or rearranged elsewhere.

Another object of the invention is to provide a machine that can interface with the known plants or installations where magnetic separation is required.

Another object of the invention is to provide a machine that can be easily and removably inserted into the known plants or installations where magnetic separation is required.

Another object of the invention is to provide a machine that is stand alone, highly versatile and is safe for use.

Another object of the invention is to provide a machine that is easily and quickly adjustable according to the needs of the specific application, even during the use.

Another object of the invention is to provide a machine that is suitable for industrial use and is highly portable, thus facilitating its movement within the yard and also its transportation between two different yards.

Another object of the invention is to provide a machine that requires little maintenance and can be of a suitably robust construction and design.

Another object of the invention is to provide a machine that is environmentally friendly, readily controllable and user-friendly.

Another object of the invention is to provide a machine that enables an accurate separation of magnetic material from non-magnetic material.

Another object of the invention is to provide a machine that enables a fast separation of magnetic material from non-magnetic material, thus allowing a high recovery of magnetic material.

Another object of the invention is to provide a machine that has an alternative and improved characterisation and design, in both constructional and functional terms, compared with the known solutions for magnetic separation.

Another object of the invention is to provide a machine of easy, quick and low-cost construction.

SUMMARY OF THE INVENTION

Accordingly, all these objects, taken individually and in any combination thereof, are achieved according to the invention by a machine for magnetic separation of material comprising a supporting structure and at least one magnetic rotating drum supported by the supporting structure, said machine further comprising a vehicle for moving and transporting said supporting structure.

Preferably, the magnetic rotating drum is mounted on or within the supporting structure.

Preferably, said vehicle comprises means for moving and transporting the supporting structure.

Preferably, said moving means comprise wheels. Preferably, said moving means comprise wheels running inside a continuous chain or tracks.

Preferably, said moving means comprise tracks. Preferably, said tracks comprise continuous tracks.

Preferably, said vehicle is self-propelled.

Preferably, said vehicle is a track-laying vehicle.

Preferably, said vehicle is a wheeled vehicle.

Preferably, said vehicle is motorized.

Preferably, said supporting structure is mounted on said vehicle. Preferably, said supporting structure rests on the ground by means of said moving means. Ideally, said supporting structure rests on the ground only by means of said moving means. Preferably, the supporting structure is mounted on a track-laying vehicle.

Preferably, the vehicle of the machine comprises ground propulsion means. Preferably, the ground propulsion means are housed within the supporting structure. Preferably, the ground propulsion means comprises an engine or motor for power generation and a power transmission system for transferring the generated power to the moving and transportation means. Ideally, the ground propulsion means comprises an engine or motor for power generation and a power transmission system for transferring the generated power to two parallel continuous tracks.

Preferably, said magnetic drum comprises an outer rotating shell and a magnetic portion positioned and housed within said outer shell. Preferably, said magnetic drum comprises an outer rotating shell and at least one magnet that is positioned within said outer shell. Preferably, the outer shell is rotatable around a central axis by a drive mechanism. Preferably, said at least one magnet is positioned in a fixed location within said outer shell.

Preferably, the rotating outer shell has a tubular length and a circular cross-section. Preferably, the tubular length is parallel to the central axis while the circular cross-section is perpendicular to the central axis. Preferably, the outer shell comprises a series of cleats for assisting the movement of the attracted magnetic/ferrous material on the outer shell.

Preferably, the magnetic portion extends along the tubular length of the rotating outer shell.

Preferably, the magnetic portion is configured to be powerful enough to attract the ferrous material from the non-ferrous material in the material stream, thus separating the ferrous material from the non-ferrous material.

Preferably, said magnetic portion is positioned within said outer shell so as to lift the magnetic materials to be separated and to carry them over said outer shell. Preferably said magnetic portion is positioned so as to act only on the upper part and/or lateral part of said outer shell.

Preferably said magnetic portion is positioned within said outer shell so as to hold the magnet materials to be separated against gravity. Preferably said magnetic portion is positioned so as to act only on the lower part and/or lateral part of said outer shell.

Preferably, said at least one magnet comprises ferrite magnet. Preferably, said at least one magnet comprises neodymium magnet. Preferably, said at least one magnet comprises electromagnet.

Preferably, said machine further comprises a feeder. Preferably, the feeder is mounted on the supporting structure. Ideally, the feeder is mounted on the same supporting structure on which is mounted the rotating magnetic drum. Preferably, said feeder is positioned on said supporting structure so as to carry the material to be separated toward the rotating magnetic drum.

Preferably, the feeder is a conveyor belt. Preferably, the feeder is a vibratory feeder tray. Preferably, the feeder is a pan feeder.

Preferably, said feeder is positioned above the rotating magnetic drum.

Preferably, said feeder is positioned below the rotating magnetic drum. Preferably, the feeder and the rotating magnetic drum are mounted in the supporting structure in a fixed way. Preferably, the distance and/or position between the feeder and the rotating magnetic drum are fixed.

Preferably, the machine comprises means for varying the reciprocal distance between the feeder and the rotating magnetic drum.

Preferably, the machine comprises means for varying the reciprocal position between the feeder and the rotating magnetic drum.

Preferably, the machine comprises means for varying the width of the gap between the end of the feeder and the outer shell of the rotating magnetic drum.

Preferably, the machine comprises means for varying the position of the feeder in respect of the rotating magnetic drum. Preferably, said means for varying the position of the feeder in respect of the rotating magnetic drum comprises first means mounted on said supporting structure and acting on the feeder. Ideally, said first means are positioned in correspondence of the end of the feeder.

Preferably, said means for varying the position of the feeder in respect of the rotating magnetic drum comprises first means configured to move the feeder between a position wherein the end of said feeder is substantially above the central rotational axis of the rotating magnetic drum and a position wherein the end of said feeder is substantially beneath the central rotational axis of rotating magnetic drum.

Preferably, said means for varying the position of the feeder in respect of the rotating magnetic drum comprises a tipping mechanism capable of raising or lowering the end of the feeding conveyor that is in correspondence of the rotating magnetic drum.

Preferably, said means for varying the position of the feeder in respect of the rotating magnetic drum comprises second means configured to move the feeder between a position wherein the end of said feeder is substantially closer to the rotating magnetic drum and a position wherein the end of said feeder is substantially further away from the rotating magnetic drum.

Preferably, said means for varying the position of the feeder in respect of the rotating magnetic drum comprises a shifting mechanism capable of approaching or getting away the end of the feeding conveyor that is in correspondence of the rotating magnetic drum to/from the rotating magnetic rotor.

Ideally, said tipping and/or shifting mechanism comprise at least one actuator mounted on the supporting structure and acting on the feeding conveyor.

Preferably, said machine comprises means for varying the position of the rotating magnetic drum in respect of the supporting structure and/or in respect of the feeder.

Preferably, said means for varying the position of the rotating magnetic drum comprises third means mounted on said supporting structure and acting on the rotating magnetic drum. Ideally, said third means are positioned in correspondence of the mounting sides of the rotating magnetic drum. Preferably, said third means are configured to vary the height of the rotating magnetic drum in respect of the supporting structure. Preferably, said third means are configured to move the rotating magnetic drum between a position wherein it is closer to the supporting structure and a position wherein it is further from the supporting structure. Preferably, said third means comprise a shifting mechanism capable of raising and lowering the height of the central axis of the rotating magnetic drum. Ideally, said shifting mechanism comprises at least one actuator mounted on the supporting structure and acting on a frame supporting the rotating magnetic drum.

Preferably, said means for varying the position of the rotating magnetic drum in respect of the end of the feeder comprises fourth means configured to move the rotating magnetic drum between a position wherein it is closer to the end of said feeder and a position wherein it is further from the end of said feeder. Preferably, said fourth means comprises a shifting mechanism capable of moving the rotating magnetic drum closer or further to/from the end of the feeder. Ideally, said shifting mechanism comprises at least one actuator mounted on the supporting structure and acting on a frame supporting the rotating magnetic drum.

Ideally, said first means and/or said second means and/or said third means and/or said fourth means comprise linear actuators, such as mechanical actuators and/or hydraulic actuators (cylinders) and/or pneumatic actuators (cylinders) and/or electromechanical actuators.

Preferably, said rotating magnetic drum comprises means for causing the rotation of the outer shell around a central axis. Preferably, said means for causing the rotation of the outer shell around a horizontal central axis are mounted on said supporting structure.

Preferably, said machine further comprises a first discharge port for the separated magnetic material. Preferably, the first discharge port is defined and housed inside the supporting structure. Preferably, said first discharge port is connected to a first discharge transfer system. Ideally, the first discharge transfer system comprises a conveyor belt mounted on said supporting structure.

Preferably, said first discharge port is positioned in correspondence of one end of the magnetic portion of the rotating magnetic drum. Preferably, said first discharge port is positioned in correspondence of the downstream end of the magnetic portion of the rotating magnetic drum.

Preferably, said machine further comprises a second discharge port for the separated non-magnetic material. Preferably, the second discharge port is defined and housed inside the supporting structure. Preferably, said second discharge port is connected to a second discharge transfer system. Ideally, the second discharge transfer system comprises a conveyor belt mounted on said supporting structure.

Preferably, said machine further comprises a first discharge port for the separated magnetic material and a second discharge port for the separated non-magnetic material. Preferably, the first discharge port and the second discharge port are both defined and housed inside the supporting structure. Preferably, said first discharge port is connected to a first discharge conveyor belt mounted on said supporting structure and said second discharge port is connected to a second discharge conveyor belt mounted on said supporting structure.

Preferably, said second discharge port for the non-magnetic material is positioned between the feeder and the rotating magnetic drum.

Preferably, the first discharge port for the magnetic material and the second discharge port for the non-magnetic material are both positioned below the rotating magnetic drum.

Preferably, the first discharge port for the magnetic material and the second discharge port for the non-magnetic material are both positioned downstream of the rotating magnetic drum.

Preferably, the second discharge port for the non-magnetic material is positioned upstream of the rotating magnetic drum while the first discharge port for the magnetic material is positioned downstream of the rotating magnetic drum.

Preferably, the advancing direction of the feeding conveyor is opposite to the rotation direction of the rotating magnetic drum. Ideally, the rotation direction of the pulley of the feeding conveyor belt is opposite to the rotation direction of the rotating magnetic drum.

Preferably, the advancing direction of the feeding conveyor corresponds to the rotation direction of the rotating magnetic drum. Ideally, the rotation direction of the pulley of the feeding conveyor belt corresponds to the rotation direction of the rotating magnetic drum.

Preferably, said first discharge conveyor and/or said second discharge conveyor are positioned below the central rotational axis of the rotating magnetic drum. Preferably, said first discharge conveyor and/or said second discharge conveyor are configured so as to have adjustable height and/or inclination.

Preferably, the first discharge conveyor and the second discharge conveyor are placed substantially perpendicularly.

Preferably, the first discharge conveyor and/or the second discharge conveyor comprise a folding conveyor belt.

Preferably, the magnetic portion is configured to vary its magnetic attraction strength along its development. Preferably, the magnetic portion is configured to vary its magnetic attraction strength along its development from one end having the highest magnetic attraction strength to the opposite end having the lowest magnetic attraction strength. Ideally, the end having the highest magnetic attraction strength is positioned in correspondence of the feeder while the end having the lowest magnetic attraction strength is positioned in correspondence of the first discharge port.

Preferably, the magnetic portion is configured to be moved within the outer shell. Preferably, the magnetic portion is configured to be rotated within the outer shell about the central axis. Preferably, the magnetic portion is configured to vary its angular position within the magnetic drum, so as to act on different parts of the outer shell.

Preferably, the magnetic portion is associated to means for causing its movement in respect of the outer shell. Preferably, said means are configured to be actuated manually and/or automatically. Ideally, said means are configured to be actuated to switch between a first position of the magnetic portion that is suitable to be used in combination with a feeder that is below the central rotation axis of the rotating magnetic drum and a second position of the magnetic portion that is suitable to be used in combination with a feeder that is above the central rotation axis of the rotating magnetic drum. Preferably, said means are configured to be actuated to move the end of the magnetic portion having the highest magnetic attraction strength in correspondence of the feeder both when is above the rotating magnetic drum and also when is below the rotating magnetic drum.

Preferably, the magnetic portion is mounted on a support, ideally a tubular support, that is associated to a linear actuator configured to causing the rotation of said support around a central axis, thus causing the movement of the corresponding magnetic portion.

Preferably, the magnetic portion is configured to vary its magnetic attraction strength along its development. Preferably, the magnetic portion is configured to decrease its magnetic attraction strength along its development from one end having the highest magnetic attraction strength to the opposite end having the lowest magnetic attraction strength. Ideally, the end having the highest magnetic attraction strength is positioned in correspondence of the feeder while the end having the lowest magnetic attraction strength is positioned in correspondence of the first discharge port.

Preferably, the end having the highest magnetic attraction strength acts as a pick-up magnet and is suitably positioned and oriented such that the generated magnetic field is directed towards the material stream on the end of the feeder. Conveniently, the zones of the magnetic portion that have a weaker magnetic attraction act substantially as carry magnets.

Preferably, the magnetic portion is configured to be moved within the outer shell. Preferably, the magnetic portion is configured to be rotated within the outer shell about the central axis. Preferably, the magnetic portion is configured to vary its angular position within the magnetic drum, so as to act on different parts of the outer shell.

Preferably, the magnetic portion is associated to means for causing its movement in respect of the outer shell. Preferably, said means are configured to be actuated manually and/or automatically. Ideally, said means are configured to be actuated to switch between a first position of the magnetic portion, that is suitable to be used in combination with a feeder that is below the central rotation axis of the rotating magnetic drum, and a second position of the magnetic portion, that is suitable to be used in combination with a feeder that is above the central rotation axis of the rotating magnetic drum. Preferably, said means are configured to be actuated to place the end having the highest magnetic attraction strength always in correspondence of the feeder both when is above the rotating magnetic drum and also when is below the rotating magnetic drum.

Preferably, the magnetic portion is mounted on a support, ideally a tubular support, that is associated to a linear actuator configured to causing the rotation of said support around a central axis, thus causing the movement of the corresponding magnetic portion.

Preferably, said supporting structure comprises a box frame for sustaining the drum.

Preferably, said supporting structure comprises a chassis on which are mounted the feeder for the material stream to be separated and the rotating magnetic drum. Preferably, the chassis contains the first discharge port for the separated magnetic material and the second discharge conveyor for the separated non-magnetic material. Preferably, on the chassis are mounted the first discharge conveyor and/or the second discharge conveyor.

Preferably, the chassis comprises a lower base, two sidewalls, a leading open wall and a trailing wall, an upper base. Ideally, the feeder is mounted above the upper base. Ideally, the lower base is longer that the upper base of the chassis so as to define an inner containing zone for the separated magnetic material. Ideally, said inner containing zone is defined in the chassis below the feeder and the rotating magnetic drum. Ideally, said containing zone is connected with a second discharge conveyor for the separated non-magnetic material.

Preferably, the moving and transporting means of the vehicle of the machine are associated to the bottom of the lower base of the chassis.

Preferably, the ground propulsion means are housed within the chassis of the supporting structure.

Preferably, the feeding conveyor, the drum and the first discharge conveyor for the magnetic material are aligned.

Ideally, the starting part of first discharge conveyor for the magnetic material is positioned above the starting part of the second discharge conveyor for the non-magnetic material.

Preferably, said machine comprises at least two magnetic rotating drums mounted on the same supporting structure and positioned in sequence. Preferably, said at least two magnetic rotating drums are positioned side by side. Preferably, said at least two magnetic rotating drums are positioned one parallel to the other.

Preferably, the machine comprises a control interface to command the operation of the rotating magnetic drum or to vary the position and/or distance between the feeder and rotating magnetic drum.

Preferably, the machine comprises a control interface to drive the vehicle on which is mounted the supporting structure, thus allowing the control of the movements of the whole machine by means of the vehicle on which the supporting structure is mounted.

The skilled man will appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

BRIEF DESCRIPTION OF THE DRAWINGS

The invention will now be described with reference to the accompanying drawings which show by way of example only one embodiment of a machine in accordance with the invention.

In the drawings.

DETAILED DESCRIPTION OF THE INVENTION

Figure 1:
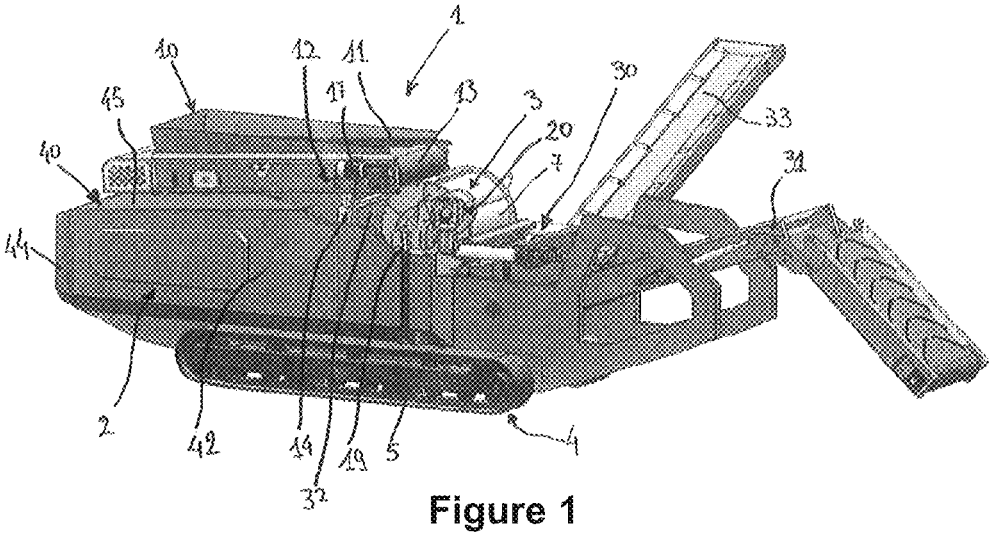
FIG. 1 is a perspective view of a machine for magnetic separation according to the invention.

Referring to the figures, there is shown a machine 1 for the magnetic separation according to the invention, said machine 1 comprising a supporting structure 2 on which is mounted a rotating magnetic drum 3.

The machine 1 is mobile since it comprises a vehicle 4 for moving and transporting the supporting structure 2 with the magnetic drum separator 3.

Conveniently, said vehicle 4 is a track-laying vehicle and comprises an arrangement 5 for moving and transporting the supporting structure 2. In particular, the arrangement 5 comprises continuous tracks and, more in detail, they are wheels running inside a continuous chain or tracks.

Advantageously, the vehicle 4 is motorized and, in particular, comprises a ground propulsion system. In particular, the ground propulsion system comprises an engine or motor for power generation and a power transmission system for providing the generated power to the two parallel continuous tracks 5. More in detail, the ground propulsion system is housed within the supporting structure 2.

Advantageously, the whole supporting structure 2 is mounted on the vehicle 4. Preferably, said supporting structure 2 rests on the ground by means of the moving arrangement 5.

Advantageously, the rotating magnetic drum 2 comprises an outer rotating shell 7 and a magnetic portion 8 positioned and housed within said outer shell 7 in a fixed location.

Advantageously, the rotating magnetic drum 3 comprises an arrangement 20 for causing the rotation of the outer shell 7 around its central axis 16.

In particular, the magnetic portion 8 comprises one or more magnets positioned within the outer rotating shell 7 so as to attract toward said shell 7 the magnetic/ferrous materials to be separated and to carry them around said shell 7.

Figure 7:
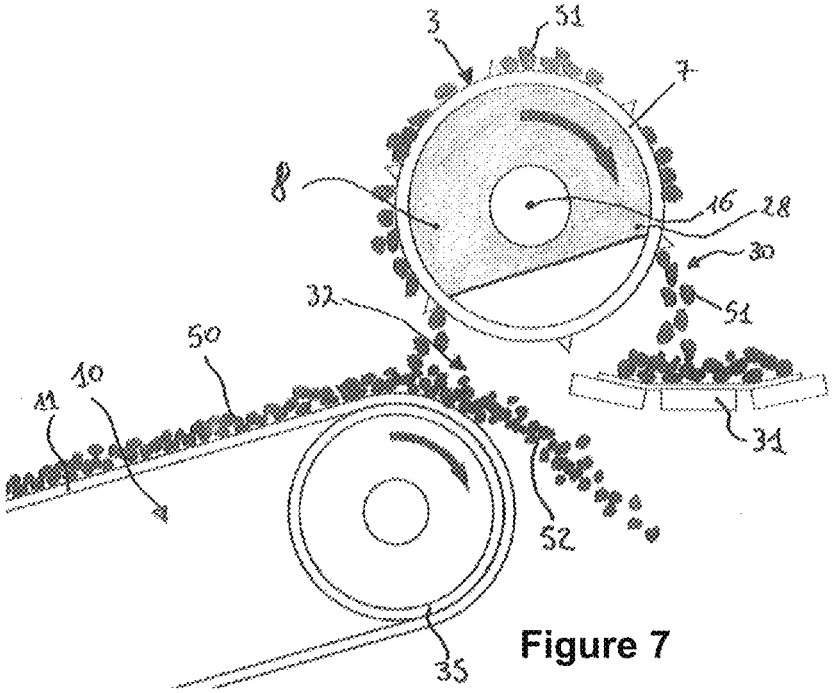
FIG. 7 is a schematic view of a second configuration of the machine according to the invention.
Figure 8:
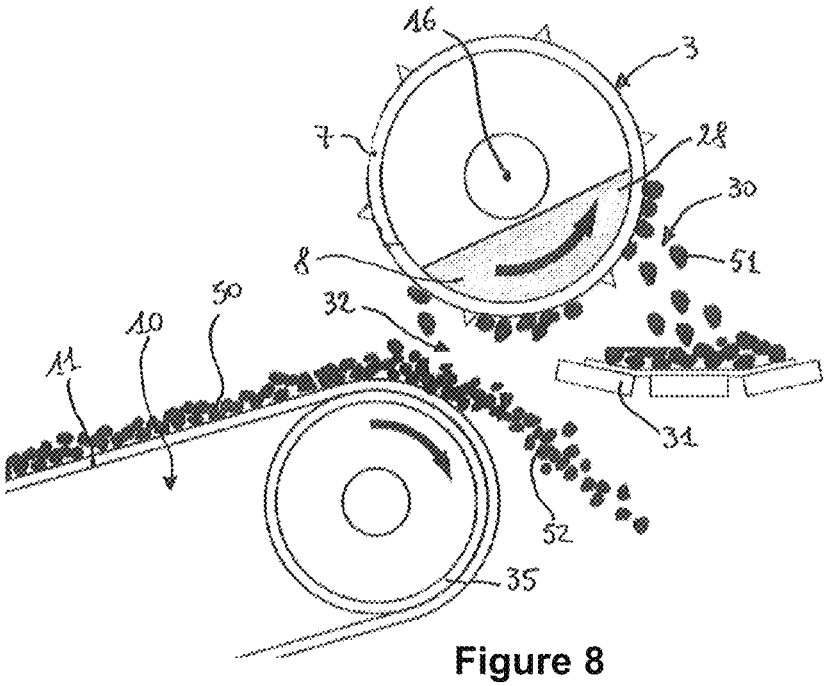
FIG. 8 is a schematic view of a third configuration of the machine according to the invention.

Preferably, the magnetic portion 8 may be positioned within the outer rotating shell 7 in its upper part and/or lateral part (see FIGS. 6 and 7) and/or in the lower part (see FIG. 8). More in detail, in the configuration of the machine 1 shown in FIG. 8, the magnetic portion 8 is positioned within said outer shell 7 so as to hold the attracted magnetic materials against gravity.

Preferably, the magnet of the magnetic portion 8 comprises one or more ferrite magnets, and/or neodymium magnets, and/or electromagnets.

Advantageously, the machine 1 further comprises a feeder 10 that is mounted on the supporting structure 2. Conveniently, the feeder 10 is positioned on the supporting structure 2 so as to carry the material stream 50 to be separated toward the rotating magnetic drum 3. In particular, it is intended that the material stream 50 to be separated/sorted comprises a mixture of magnetic/ferrous material 51 and of non-magnetic/non-ferrous material 52.

Figure 6:
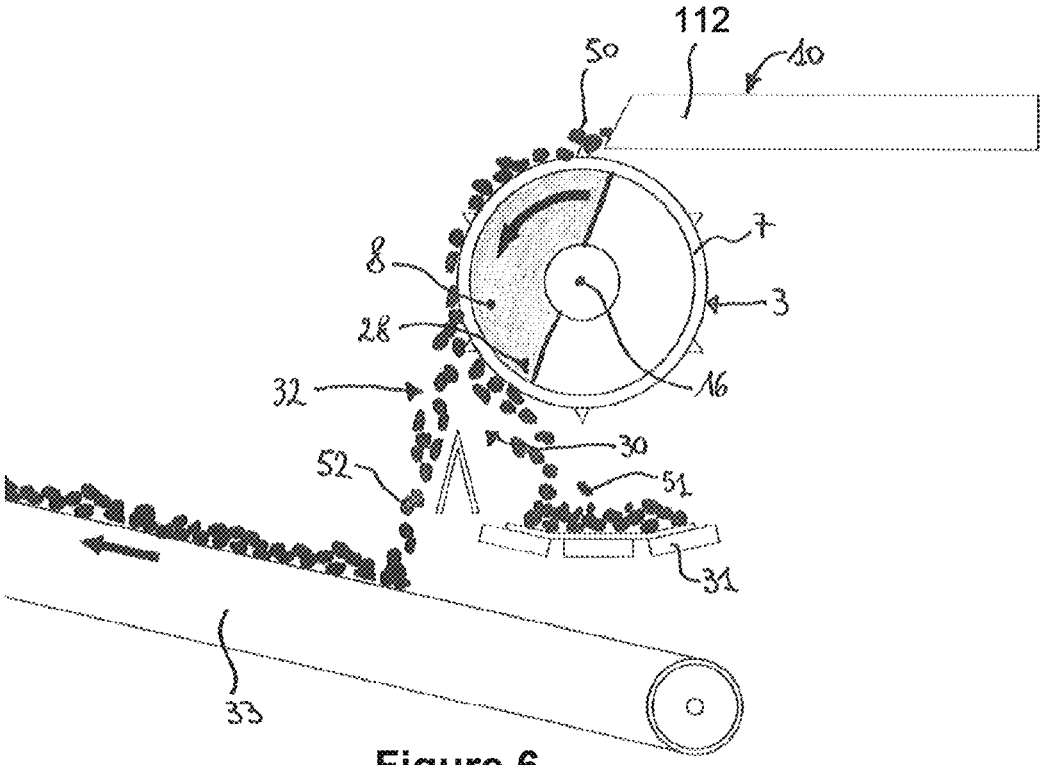
FIG. 6 is a schematic view of a first configuration of the machine according to the invention.

Preferably, the feeder 10 is a feeding conveyor belt 11 (see FIGS. 7 and 8) or a pan feeder 12 (see FIG. 6).

Advantageously, in one embodiment of the machine 1, the feeder 10 may be positioned above or below the central rotational axis 16 of the rotating magnetic drum 3 in a fixed way. Advantageously, the feeder 10 and the rotating magnetic drum 3 are mounted in the supporting structure 2 in a fixed way. In particular, it means that the reciprocal distance and position between the feeder 10 and the rotating magnetic drum 3 is fixed.

Advantageously, in a preferred embodiment of the machine 1 as shown in FIGS. 1-5, the machine 1 comprises an arrangement 12 for varying the reciprocal distance and position between the feeder 10 and the rotating magnetic drum 3. In particular, this arrangement 12 allows varying the width of the gap between the end 13 of the feeder 10 and the outer shell 7 of the rotating magnetic drum 3.

Advantageously, the arrangement 12 comprises first assembly 14 and second assembly 17 for varying the position of the feeder 10 in respect of the rotating magnetic drum 3. In particular, the first assembly 14 and second assembly 17 are mounted on the supporting structure 2 and act on the feeder 10. Ideally, the first assembly 14 and second assembly 17 are positioned in correspondence of the end 13 of the feeder 10.

Preferably, the first assembly 14 is configured to move the feeder 10 between a position wherein the end 13 of the feeder 10 is substantially above the central rotational axis 16 of the rotating magnetic drum 3 and a position wherein the end 13 of said feeder 10 is substantially beneath the central rotational axis 16 of rotating magnetic drum 3. In particular, the first assembly 14 comprises a tipping mechanism capable of raising or lowering the end 13 of the feeding conveyor belt 11 in respect of the rotating magnetic drum 3.

Preferably, the arrangement 12 comprises second assembly 17 configured to move the feeder 10 between a position wherein the end 13 of the feeder 10 is substantially closer to the rotating magnetic drum 3 and a position wherein the end 13 of the feeder 10 is substantially further away from the rotating magnetic drum 3. In particular, the second assembly 17 for varying the position of the feeder in respect of the rotating magnetic drum comprises a shifting mechanism capable of approaching or moving away the end 13 of the feeding conveyor belt 11 to/from the rotating magnetic rotor 3.

More in detail, the tipping mechanism of the first assembly 14 and/or the shifting mechanism of the second assembly 17 comprises at least one linear actuator mounted on the supporting structure 2 and acting on the feeder 10.

Advantageously, the arrangement 12 further comprises a third assembly 19 for varying the position of the rotating magnetic drum 3 in respect of the supporting structure 2. Preferably, the third assembly 19 is mounted on said supporting structure 2 and acts on the rotating magnetic drum 3. Ideally, the third assembly 19 is positioned in correspondence of mounting sides of the rotating magnetic drum 3 and is configured to vary the height/distance of the central rotational axis 16 of the rotating magnetic drum 3 in respect of the supporting structure 2. Preferably, said third assembly 19 comprises a sliding mechanism capable of raising and lowering the height/distance of the rotating magnetic drum 3 in respect of the supporting structure 2. More in detail, the sliding mechanism comprises linear actuators mounted on the supporting structure 2 and acting on a frame of the rotating magnetic drum 3.

Advantageously, the machine 1 further comprises within said supporting structure 2 a first discharge port 30 for the separated magnetic material 51. Preferably, the first port 30 is connected to a first discharge conveyor belt 31 that is mounted on the supporting structure 2.

In particular, the first port 30 is positioned in correspondence of one end 28 of the magnetic portion 8 of the rotating magnetic drum 3.

Advantageously, the machine 1 further comprises within said supporting structure 2 a second discharge port 32 for the separated non-magnetic material 52. Preferably, the second port 32 is connected to a second discharge conveyor belt 33 that is mounted on the supporting structure 2.

Conveniently, the second discharge port 32 for the non-magnetic material 52 is positioned between the feeder 10 and the rotating magnetic drum 3.

Conveniently, the first discharge port 30 for the magnetic material 51 and the second discharge port 32 for the non-magnetic material 52 are both positioned below the rotation axis 16 of the rotating magnetic drum 3.

Preferably, in the configurations shown in FIGS. 1-5, 7 and 8, the second discharge port 32 for the non-magnetic material 52 is positioned upstream of the rotating magnetic drum 3 while the first discharge port 30 for the magnetic material 51 is positioned downstream of the rotating magnetic drum 3.

Preferably, in the configuration shown in FIG. 6, the first discharge port 30 for the magnetic material and the second discharge port 32 for the non-magnetic material 52 are both positioned downstream of the rotating magnetic drum 3.

In the configuration shown in FIG. 7, the rotation direction of the pulley 35 of the feeding conveyor belt 11 corresponds to the rotation direction of the outer shell 7 of the rotating magnetic drum 3.

In the configuration shown in FIG. 8, the rotation direction of the pulley 35 of the feeding conveyor belt 11 is opposite to the rotation direction of the outer shell 7 of the rotating magnetic drum 3.

The first discharge conveyor 31 and/or said second discharge conveyor 33 are positioned below the rotational axis 16 of the rotating magnet drum 3. Conveniently, the first discharge conveyor 31 and/or said second discharge conveyor 33 are configured so as to have adjustable height and inclination.

Preferably, the first discharge conveyor 31 and the second discharge conveyor 33 are placed substantially perpendicularly. Preferably, the first discharge conveyor 31 and/or the second discharge conveyor 33 comprise a folding conveyor belt.

Advantageously, the supporting structure 2 comprises a chassis 40 on which are mounted the feeder 10 for the material stream 50 to be separated and the rotating magnetic drum 3, the first discharge conveyor 31 and the second discharge conveyor 33. Moreover, the first discharge port 30 and the second discharge port 32 are defined within the chassis 40 of the supporting structure 2.

Preferably, the chassis 40 comprises a lower base, two side walls 42, a leading open wall, a trailing wall 44 and an upper base 45. In particular, the feeder 10 is mounted on the upper base 45.

Preferably, the moving and transporting means 5 are associated to the bottom of the lower base of the chassis 40.

More in detail, the lower base is longer that the upper base 45 of the chassis 40 so as to define an inner containing zone 46 for the separated non-magnetic material 52. Ideally, said inner containing zone 46 is defined in the chassis below the feeder 10 and below the rotating magnetic drum 3. Conveniently, the containing zone 46 is connected with a second discharge conveyor 32 for the separated non-magnetic material 52.

Advantageously, within the supporting structure 2 of the machine 1, the feeding conveyor belt 11, the rotating magnetic drum 3 and the first discharge conveyor 31 for the magnetic material are aligned.

Preferably, in the configurations of FIGS. 1-6, the starting part 36 of first discharge conveyor 31 for the magnetic material is positioned above the starting part 37 of the second discharge conveyor 33 for the non-magnetic material.

Advantageously, the magnetic portion 8 is configured to have a variable magnetic attraction strength along its development, preferably along a development corresponding to the arc of a semicircle. In particular, the magnetic portion 8 has a magnetic attraction strength that decreases from one end 29, having the highest magnetic attraction strength, to the opposite end 28 having the lowest magnetic attraction strength. Ideally, the end 29 having the highest magnetic attraction strength is positioned in correspondence of the feeder 10 while the end 28 having the lowest magnetic attraction strength is positioned in correspondence of the first discharge port 30. For the purpose of illustration, it is intended that the variable magnetic attraction strength corresponds to the variable magnetic fields that are generated along the development of the magnetic portion 8 and are depicted as dashed lines emanating from the outer shell 7.

Conveniently, the first end 29 of the magnetic portion 8 (i.e. the end having the highest magnetic attraction strength) acts as a pick-up magnet and is suitably positioned and oriented such that the generated magnetic field is directed towards the material stream 50 on the end 13 of the feeder 10. Conveniently, the zones of the magnetic portion 8 that have a magnetic attraction strength weaker than the one of the first end 29 act substantially as carry magnets.

Advantageously, the magnetic portion 8 is configured to be moved within the outer shell 7. In particular, the magnetic portion 8 is configured to vary its angular position within the magnetic drum 3, so as to act on different parts of the outer shell 3. Preferably, to this aim, the magnetic portion 8 is associated to arrangement 39 for causing its movement within and in respect of the outer shell 7. Conveniently, the arrangement 39 is configured to be actuated manually and/or automatically.

Figure 9:
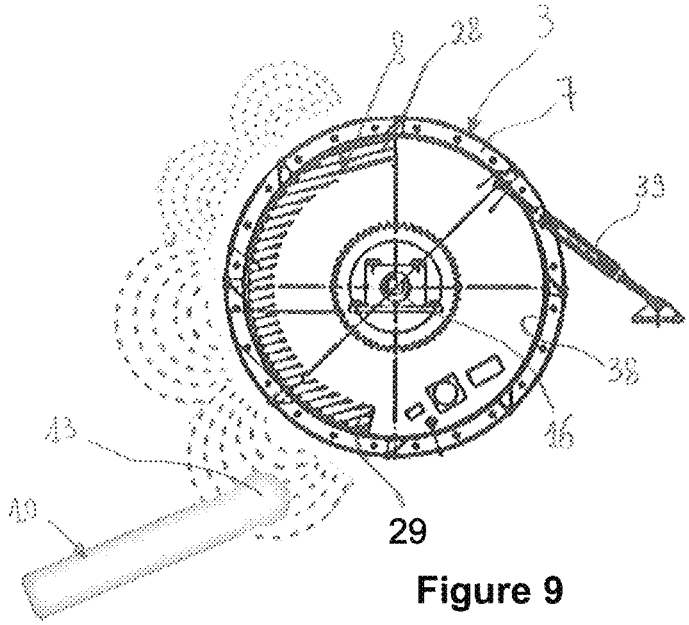
FIG. 9 is a schematic view of a particular embodiment of the machine according to the invention, wherein the movable magnetic portion is in a first position that is suitable to be used when the feeder is positioned below the rotating magnetic drum.
Figure 10:
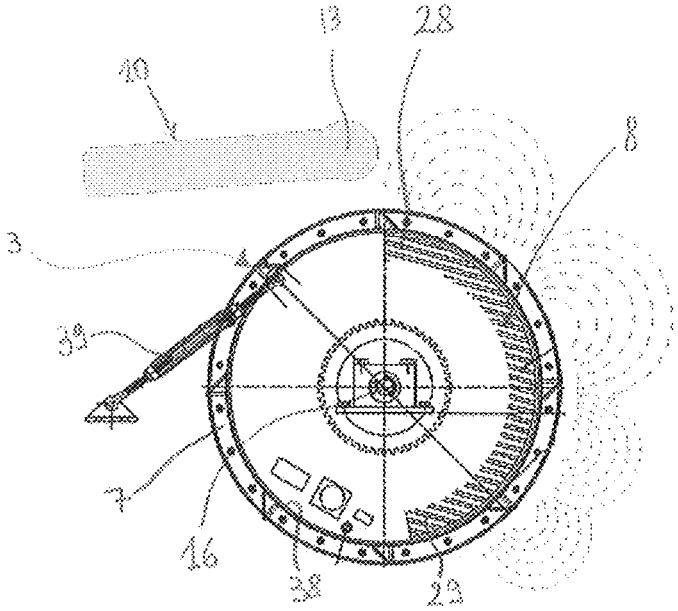
FIG. 10 is a schematic view of a particular embodiment of the machine according to the invention, wherein the movable magnetic portion is in a second position that is suitable to be used when the feeder is positioned above the rotating magnetic drum.

Ideally, the arrangement 39 is configured to be actuated to switch between a first position of the magnetic portion 8 (as shown in FIG. 9), that is suitable to be used in combination with a feeder 10 that is below the central rotation axis 16 of the rotating magnetic drum 3, and a second position of the magnetic portion 8 (as shown in FIG. 10), that is suitable to be used in combination with a feeder 10 that is above the central rotation axis 16 of the rotating magnetic drum 3. Conveniently, said arrangement 39 comprise a linear actuator and is configured to be actuated so as to place the end 28 (i.e. the end having the highest magnetic attraction strength) always in correspondence of the feeder 10, both when the latter is above the rotating magnetic drum 3 and also when it is below the rotating magnetic drum 3.

More in detail, the magnetic portion 8 is mounted on a tubular support 38 that is associated to the linear actuator 39 configured to causing the rotation of said support around the central axis 16, thus causing the movement of the opposite ends 28, 29 of the corresponding magnetic portion 8.

The operation of the machine 1 according to the invention results clearly by the above description of the same machine. In particular, the material stream to be separated 50 coming from the feeder 10 arrives in correspondence of the rotating magnetic drum 3 wherein the magnetic portion 8 picks up only the magnetic/ferrous material 51 of the stream 50, while the non-magnetic/non-ferrous material 52 is not affected by the attraction of the magnetic portion 8 and falls straight through the second discharge port 32 into the second discharge conveyor 33. The attracted magnetic/ferrous material 51 is held on the outer shell 7 of the drum 3 until, by means of the rotation of said shell, reaches the end 28 of the magnetic portion 8 where it drops off through the first discharge port 30 into the first discharge conveyor 31.

Advantageously, the configuration of the machine 1 as shown in FIG. 1—wherein the feeder 1 is placed above the rotating magnetic drum 3—allows a high ferrous recovery as the stream 50 is delivered onto the magnetic portion 8 of the drum 3, thus it just needs to hold onto the ferrous pieces. However, in this configuration it is reduced the quality of the recovered ferrous materials as often non-ferrous pieces are trapped between ferrous pieces and the magnet portion 8.

Figure 2:
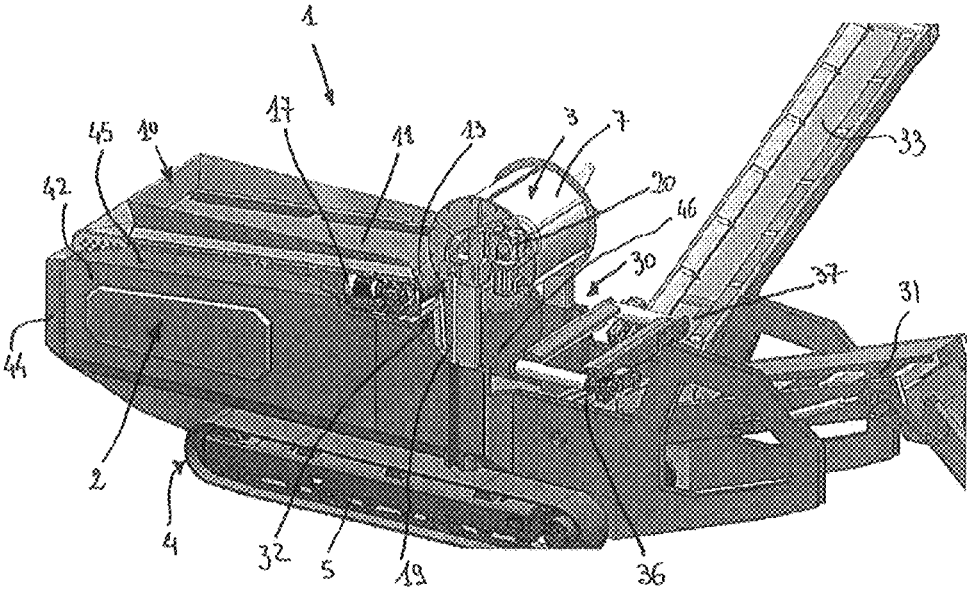
FIG. 2 is a perspective view of a particular embodiment of the machine of FIG. 1 wherein the feeder is positioned below the rotating magnetic drum.

Advantageously, the configuration of the machine 1 as shown in FIG. 2—wherein the feeder 1 is placed beneath the rotating magnetic drum 3—allows a high quality of recovered ferrous materials 51 as the ferrous pieces are lifted out from the material stream 50 by the magnet portion 8 of the rotating magnetic drum 3. However, in this configuration it is reduced the total ferrous recovery as some pieces may not be lifted due to their shape or being trapped underneath non-magnetic/non-ferrous pieces.

Figure 3:
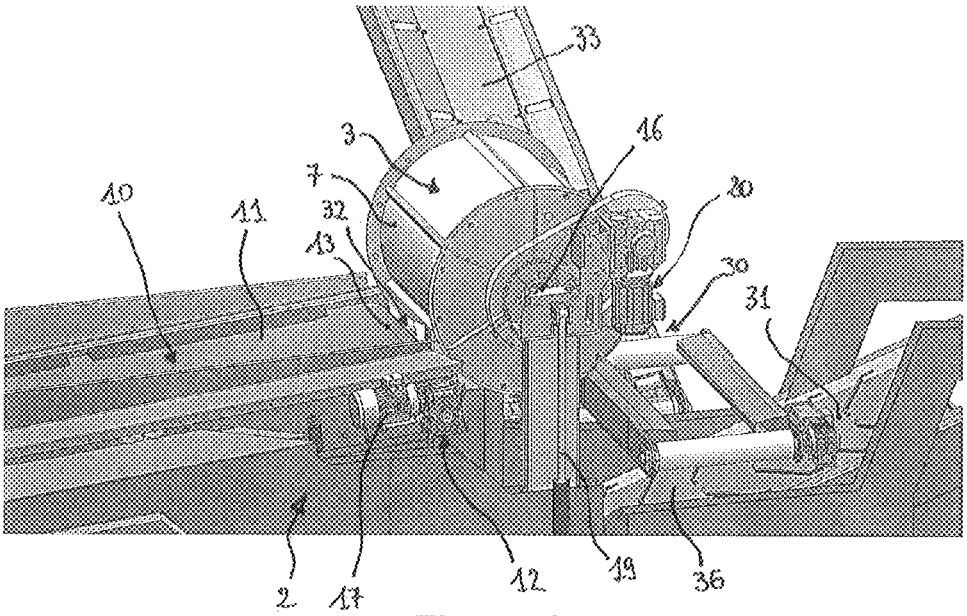
FIG. 3 is a perspective view of a particular embodiment of the machine of FIG. 1 wherein the feeder is positioned proximal the rotating magnetic drum.

Advantageously, the configuration of the machine 1 as shown in FIG. 3—wherein the feeder 1 is closer to the rotating magnetic drum 3—allows for greater rates of recovery as magnetic strength is higher, thus having substantially the same effects as the configuration shown in FIG. 1. However, in this configuration it is reduced the quality of the recovered ferrous material 51 as the extra strength at closer distances lifts more non-ferrous/non-magnetic pieces along with ferrous/magnetic pieces.

Figure 4:
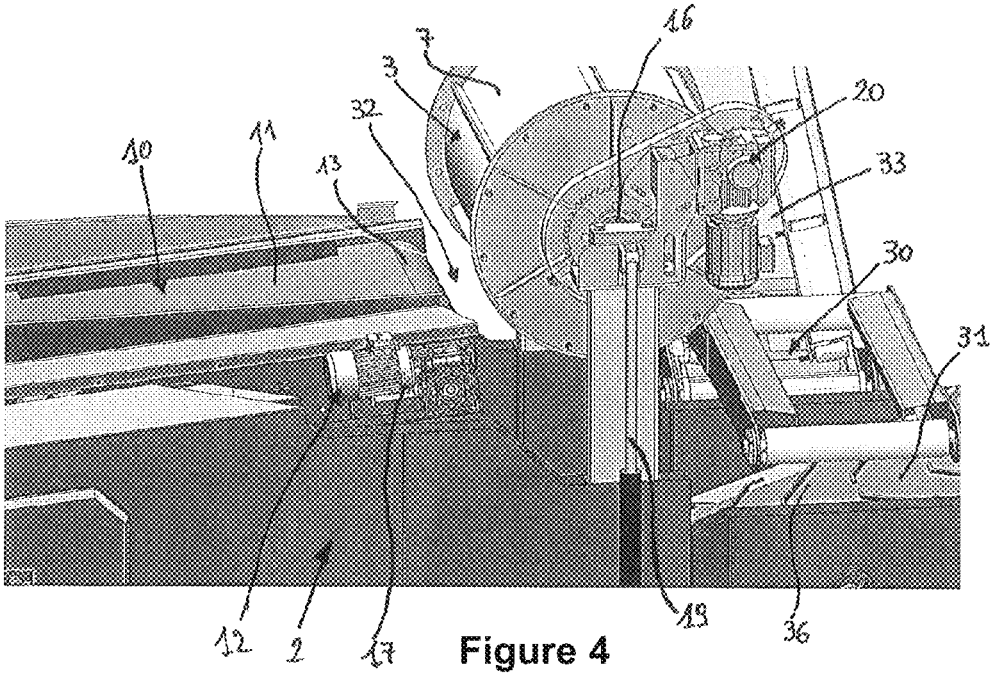
FIG. 4 is a perspective view of a particular embodiment of the machine of FIG. 1 wherein the feeder is positioned distal to the rotating magnetic drum.

Advantageously, the configuration of the machine 1 as shown in FIG. 4—wherein the feeder 1 is further from the rotating magnetic drum 3—allows for an increased quality of recovered ferrous material 51 as the amount of trapped non-magnetic/non-ferrous pieces decreases as the magnetic strength is lower at the greater distance. However, in this configuration the total ferrous material recovery is reduced since the magnetic strength is lowered in view of the increased distance, thus only high grade strongly ferrous/magnetic pieces are lifted.

Figure 5:
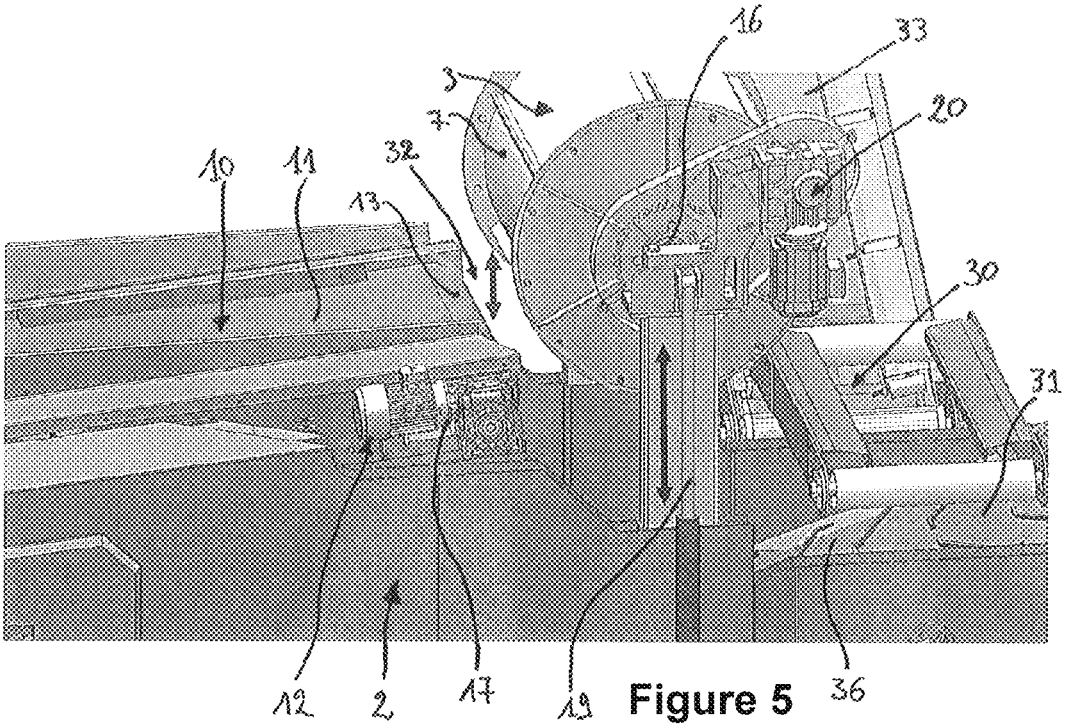
FIG. 5 is a perspective view of a particular embodiment of the machine of FIG. 1 illustrating height adjustment of the rotating magnetic drum.

Advantageously, the configuration of the machine 1 as shown in FIG. 5—wherein the height of the rotating magnetic drum 3 can be adjusted—allows reaching the same effects of the configuration shown in FIGS. 3 and 4. More in detail, a larger gap between the rotating magnetic drum 3 and the feeder 10 increases the quality of the recovered ferrous material 51 while reduces its total recovery. On the contrary, a smaller gap between the rotating magnetic drum 3 and the feeder 10 increases the total ferrous recovery while the quality of the recovered ferrous material is reduced.

Advantageously, the configuration of the machine 1 as shown in FIG. 6, wherein the feeder 10 is placed above the rotating magnetic drum 3, is suitable for "non-sticky" materials and large iron (ferrous) pieces and, in particular, can be used to separate large ferrous parts from shredded or unshredded materials.

Advantageously, the configuration of the machine 1 as shown in FIG. 7—wherein the feeder 10 is placed below the rotating magnetic drum 3 and wherein the ferrous/magnetic materials 51 is lifted and carried over the drum—is suitable for providing a cleaner ferrous/magnetic fraction than the one of FIG. 6. Conveniently, in this configuration, the agitator pole pushes ferrous/magnetic material 51 out from the stream 50 and snaps it back to shake out entrapped non-ferrous/non-magnetic material 52.

Advantageously, the configuration of the machine 1 as shown in FIG. 8—wherein the feeder 10 is placed below the rotating magnetic drum 3 and wherein the ferrous/magnetic material 51 is held on the outer shell 7 of said drum 3 against gravity—is suitable for providing a cleaner ferrous/magnetic fraction than the ones of FIGS. 7 and 8 and, moreover, allows a removal of fluff even without the need of air separation.

Figure 11:
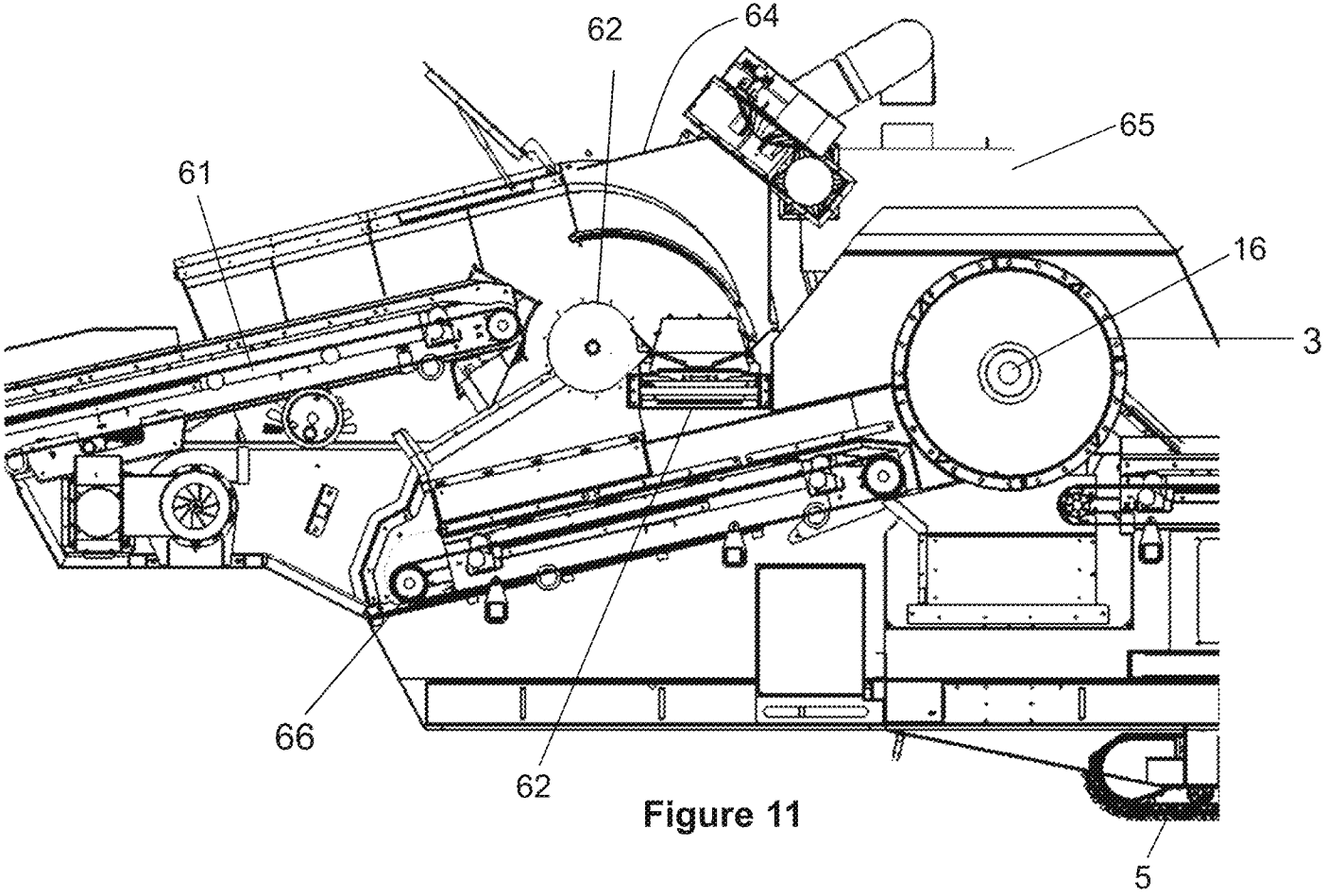
FIG. 11 is a partial view of a particular embodiment of a machine for magnetic separation also having air separators.

In a further embodiment as illustrated in FIG. 11 showing a further embodiment of magnetic separator machine 1 having tracks 5 and a rotating magnetic drum 3 rotating on axis 16. In this embodiment, there is a main feed conveyor 61 providing a feed of magnetic and non-magnetic material as well as lights and super light material. In this embodiment a blower fan arrangement 62 mounted on the same mobile support structure 2 and vehicle 4 as the rotating magnetic drum 3 is used to separate the lights from the waste material. In addition to or by itself, there is also provided a suction fan arrangement 64 mounted on the same support structure 2 and vehicle 4 as the rotating magnetic drum 3 and being connected to a cyclone 65 for removing super lights from the waste stream. This is prior to the waste stream reaching the rotating magnetic drum 3 via the magnetic and non-magnetic waste material feeder 66.

From the above disclosure, the advantages of the machine according to this invention are apparent, since by providing a vehicle for the movement and transportation of the supporting structure on which is mounted the rotating magnetic drum it allows to have a rotating magnetic drum that is fully mobile, thus being easily movable and usable elsewhere; in particular, it allows to avoid the procedures, costs and works that instead are always necessary in the known fixed plants and installations. Moreover, the machine according to the invention is fully, quickly and easily adjustable, thus being suitable to be used in many different applications.

Conveniently, the machine according to the invention may be used in several different applications, such as slag industry, scrap metal, bottom ash, waste recycling, incinerators, and wood recycling.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

What is claimed is:

1. A machine for magnetic separation of material comprising a supporting structure and at least one magnetic rotating drum supported by the supporting structure, said machine further comprising a vehicle for moving and transporting said supporting structure, the machine further comprising a feeder and means for varying the position between the feeder and the rotating magnetic drum, the said means for varying the position of the feeder in respect of the rotating magnetic drum comprising first means configured to move the feeder between a position wherein an end of said feeder is above the central rotational axis of the rotating magnetic drum and a position wherein the end of said feeder is beneath the central rotational axis of the rotating magnetic drum.

2. The machine as claimed in claim 1, wherein the vehicle comprises means for moving and transporting the supporting structure, said supporting structure is mounted on said vehicle, said supporting structure rests on the ground by means of said vehicle.

3. The machine as claimed in claim 1, wherein said magnetic drum comprises an outer rotating shell and a magnetic portion comprising at least one magnet positioned and housed within said outer shell, the outer shell being rotatable around a central axis by a drive mechanism and said at least one magnet being positioned in a fixed location within said outer shell.

4. The machine as claimed in claim 3, wherein the rotating outer shell has a tubular length and a circular cross-section, the tubular length being parallel to the central axis while the circular cross-section is perpendicular to the central axis.

5. The machine as claimed in claim 3, wherein the magnetic portion extends along the tubular length of the rotating outer shell, the magnetic portion being configured to be powerful enough to attract the ferrous material from the non-ferrous material in the material stream, thus separating the ferrous material from the non-ferrous material.

6. The machine as claimed in claim 1, wherein said machine further comprises a feeder, the feeder being mounted on the same supporting structure on which is mounted the rotating magnetic drum, said feeder being positioned on said supporting structure so as to carry the material to be separated toward the rotating magnetic drum.

7. The machine as claimed in claim 6, wherein said feeder is positioned above or below the rotating magnetic drum, the machine comprising means for varying the reciprocal distance and position between the feeder and the rotating magnetic drum.

8. The machine as claimed in claim 6, the first means being mounted on said supporting structure and acting on the feeder, said first means are positioned in correspondence of the end of the feeder.

9. The machine as claimed in claim 6, wherein said means for varying the position of the feeder in respect of the rotating magnetic drum comprises a tipping mechanism capable of raising or lowering the end of the feeder that is in correspondence of the rotating magnetic drum, said means for varying the position of the feeder in respect of the rotating magnetic drum comprises second means configured to move the feeder between a position wherein the end of said feeder is substantially closer to the rotating magnetic drum and a position wherein the end of said feeder is substantially further away from the rotating magnetic drum.

10. The machine as claimed in claim 6, wherein said machine comprises means for varying the position of the rotating magnetic drum in respect of the supporting structure and in respect of the feeder, said means for varying the position of the rotating magnetic drum comprises third means mounted on said supporting structure and acting on the rotating magnetic drum, said third means are positioned in correspondence of mounting sides of the rotating magnetic drum, said third means are configured to vary the height of the rotating magnetic drum in respect of the supporting structure.

11. The machine as claimed in claim 3, wherein said rotating magnetic drum comprises means for causing the rotation of the outer shell around a central axis, said means for causing the rotation of the outer shell around a horizontal central axis are mounted on said supporting structure.

12. The machine as claimed in claim 1, wherein said machine further comprises a first discharge port for the separated magnetic material, the first discharge port is defined and housed inside the supporting structure, said first discharge port is connected to a first discharge transfer system, the first discharge transfer system comprises a conveyor belt mounted on said supporting structure, said first discharge port is positioned in correspondence of one end of the magnetic portion of the rotating magnetic drum, said first discharge port is positioned in correspondence of the downstream end of the magnetic portion of the rotating magnetic drum.

13. The machine as claimed in claim 1, wherein said machine further comprises a second discharge port for the separated non-magnetic material, the second discharge port is defined and housed inside the supporting structure, said second discharge port is connected to a second discharge transfer system, the second discharge transfer system comprises a conveyor belt mounted on said supporting structure.

14. The machine as claimed in claim 6, wherein the feeder is a feeding conveyor belt and the advancing direction of the feeding conveyor belt is opposite to the rotation direction of the rotating magnetic drum.

15. The machine as claimed in claim 6, wherein the magnetic portion is configured to vary its magnetic attraction strength along its development, the magnetic portion is configured to vary its magnetic attraction strength along its development from one end having the highest magnetic attraction strength to the opposite end having the lowest magnetic attraction strength, the end having the highest magnetic attraction strength is positioned in correspondence of the feeder while the end having the lowest magnetic attraction strength is positioned in correspondence of the first discharge port.

16. The machine as claimed in claim 3, wherein the magnetic portion is configured to be moved within the outer shell, the magnetic portion is configured to be rotated within the outer shell about the central axis, the magnetic portion is configured to vary its angular position within the magnetic drum, so as to act on different parts of the outer shell.

17. The machine as claimed in claim 3, wherein the magnetic portion is mounted on a support that is associated to a linear actuator configured to causing the rotation of said support around a central axis, thus causing the movement of the corresponding magnetic portion.

18. The machine as claimed in claim 1, wherein said supporting structure comprises a box frame for sustaining the drum, said supporting structure comprises a chassis on which are mounted the feeder for the material stream to be separated and the rotating magnetic drum, the chassis contains the first discharge port for the separated magnetic material and the second discharge conveyor for the separated non-magnetic material.

19. The machine as claimed in claim 1, wherein the vehicle is motorized.

20. The machine as claimed in claim 6, wherein the feeder is a feeding conveyor belt and the advancing direction of the feeding conveyor belt corresponds to the rotation direction of the rotating magnetic drum.

* * * * *